United States Patent [19]

Carter

[11] 4,387,751

[45] Jun. 14, 1983

[54] AUTOMATIC FENCE PICKET POINTING MACHINE

[76] Inventor: Charles P. Carter, 301 SW. 46, Oklahoma City, Okla. 73109

[21] Appl. No.: 239,965

[22] Filed: Mar. 3, 1981

[51] Int. Cl.[3] ..... B27M 3/00

[52] U.S. Cl. ..... 144/30; 144/142; 269/58; 269/229

[58] Field of Search ..... 144/30, 141, 142, 143, 144/145 R; 269/56, 58, 229

[56] References Cited

U.S. PATENT DOCUMENTS 2,600,055 6/1949 Hansen ..... 144/141

3,719,216 3/1973 Tracy ..... 144/30

*Primary Examiner*—W. D. Bray

*Attorney, Agent, or Firm*—Robert K. Rhea

[57] ABSTRACT

An elongated upright open framework defines a vertical workpiece passageway intermediate the frame sides and ends open toward one end of the frame bottom portion for horizontally receiving workpieces from a laterally disposed feed conveyor. The frame supports a carriage for reciprocation between its ends which is driven by a drive motor and a drive train. Pairs of clamp jaws, disposed at respective end portions of the carriage, are opened and closed by carriage movement to grip and release the respective workpiece end portions as it travels with the carriage. One pair of clamp jaws is moved by cam rollers following a cam groove on inner surfaces of the frame to contact one end portion of the workpiece with rotary cutters disposed above and below the travel path of the carriage as the carriage moves to a workpiece release position. A drive motor operated conveyor discharges the finished workpiece from the frame.

9 Claims, 16 Drawing Figures

AUTOMATIC FENCE PICKET POINTING MACHINE

BACKGROUND OF THE INVENTION

1. Field of the Invention

The present invention relates to woodworking machines and more particularly to machines of the type generally referred to as picket headers capable of arcuately shaping or pointing the ends of fence pickets.

It is common practice to form enclosures or privacy fences by a plurality of vertically disposed closely spaced elongated relatively narrow boards or slats. To enhance the fence appearance and form a finished top edge, the upper end portion of the respective picket is arcuately shaped from opposing sides to form a gothic arch or tip on the respective picket. Since the number of pickets are numerous in building a fence around even a relatively small enclosure, it is desirable to provide a machine for forming the arcuate cuts pointing the respective pickets.

2. Description of the Prior Art

Fence pickets, as presently used, are formed from wood stock of a selected length commonly referred to as 2×4 stock in which one end of the 2×4 is cut to form the arcuate pointed end and thereafter the stock is longitudinally split to form two, 1×4 pickets, each having the desired pointed end. Heretofor the pointed end has been formed by manually guiding a power saw which is time consuming and inefficient from a labor cost standpoint.

The most pertinent prior patent is believed to be U.S. Pat. No. 2,600,055 which provides a frame having a horizontal platform-like top supporting a clamping arrangement for gripping a plurality of juxtaposed picket forming members. The frame pivotally supports a motor driven cutter in which the arc of travel of the rotating cutter arcuately cuts one side of the end portion of the several pickets. Following the first cut, the clamping means must be released and the pickets inverted and reclamped for the successive or second cut to complete the pointed end, thus, at least one workman is required to position, reposition, remove and then add more picket forming stock which is a relatively slow time consuming task relative to the number of pickets being formed.

This invention is distinctive over the prior art by providing a machine which includes an upstanding open frame adjacent a picket supply conveyor, for delivery of the stock in sequence with the machine action. The stock is successively received by a motor driven reciprocating carriage, automatically clamped at its respective ends and moved by the carriage into contact with rotating cutters to form the arcuate pointed end, after which the carriage clamps releases the finished point stock for discharge from the frame.

SUMMARY OF THE INVENTION

An upright elongated open frame, provided with tracks intermediate its height, horizontally supports a longitudinally reciprocating carriage receiving picket forming workpieces sequentially delivered to the top of the frame by a supply conveyor disposed laterally of the frame to fall by gravity on the carriage. The carriage is provided with workpiece clamping members at its respective ends actuated by trigger means at the end limits of its movement. One of the clamp members is supported by cams mounted on the frame guiding one end portion of the workpieces into contact with rotating cutter heads as the carriage is moved in one direction. Following the cutting sequence, the clamp members release the workpiece to fall by gravity on a discharge conveyor moving the workpiece to a resaw station where the workpiece is longitudinally split to form two finished pickets.

The principal object of this invention is to provide a machine for sequentially receiving picket forming workpieces from a supply conveyor and automatically move the workpieces in sequence into contact with picket pointing cutters and discharge the workpiece from the machine in a continuous operation.

DESCRIPTION OF THE PREFERRED EMBODIMENTS

Figure 1:
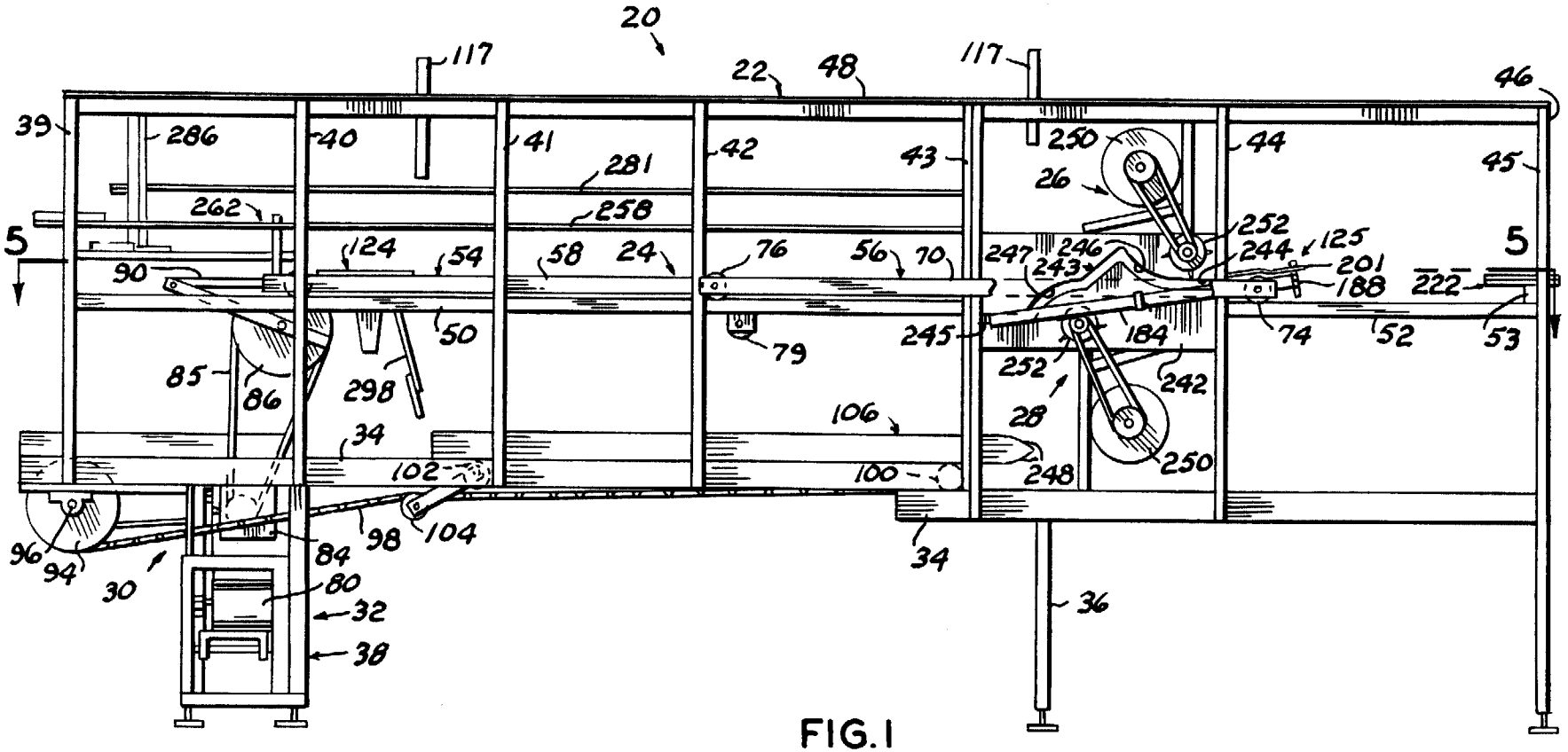
FIG. 1 is a side elevational view of the machine with parts omitted or broken away for clarity.

Like characters of reference designate like parts in those figures of the drawings in which they occur.

In the drawings:

The reference numeral 20 indicates the machine, as a whole, which is elongated upright rectangular in general configuration. The machine 20 comprises an open framework 22 underlying a portion of a workpiece supply conveyor 23 and having a horizontally reciprocating workpiece carriage 24 intermediate its height, upper and lower rotary cutter means 26 and 28 at one end portion, a discharge conveyor 30 at its other end portion, and carriage and conveyor drive means 32. The frame 22 is formed by pairs of elongated parallel spaced-apart channel members 34 extending longitudinally of the frame and supported on a horizontal surface by a plurality of supports 36 and a drive means frame 38. A plurality of pairs of upright standards 39-39'; 40-40'; 41-41'; 42-42'; 43-43'; 44-44' and 45-45', respectively, disposed in longitudinally spaced relation at opposing sides of the frame, are secured to and project upwardly from respective opposing sides of the channels 34 in parallel spaced relation with the standards 45-45' supporting the forward end 46 of the frame. The several standards are interconnected at their upper ends longitudinally of the frame by a pair of horizontal frame top rails 47 and 48 (FIG. 3) with the top rails joined at their respective ends by cross braces 49. A pair of parallel rearward tracks 50 and 51 extend between and are horizontally secured to the inner surface of the pairs of standards 39-39' to 43-43'. Similarly, a pair of forward tracks 52 extend horizontally between and are secured to the outer surfaces of the pairs of standards 42-42'; 43-43'; 44-44' and to the ends of a track cross bar 53 supported by the standards 45-45' in horizontal alignment with the rearward tracks 50 and 51. The pairs of tracks 50-51 and 52 support the carriage 24, as presently explained.

The cutting means 26 and 28 is disposed between the rearward and forward tracks 50-51 and 52 in the spacing between the pairs of standards 43-43' and 44-44', in the manner presently explained.

Carriage Means

Longitudinally, the carriage 24, supported by the tracks 50-51 and 52, is less than the overall length of the frame 22 so that the carriage may reciprocate between the ends of the frame. The carriage is defined by a rearward section 54 and a forward section 56. The section 54 comprises a pair of parallel rails 58 and 60 disposed between the standards and interconnected at their rearward ends by a box channel 62 and supported at their forward ends on the tracks 50-51 by a pair of pulley-like wheels 64 and 65 with a second pair of track supported wheels 66 and 68 disposed forwardly of the box channel 62. The forward end of the carriage 56 similarly comprises a pair of elongated rails 70 and 72 disposed outwardly of the frame standards journalling a pair of pulley-like track supported wheels 74 at their forward ends and are similarly track supported at their rearward ends by a pair of pulley wheels 76 and 78 respectively mounted on the axles of the pulley wheels 64 and 65. The respective pairs of pulley wheels are each characterized by a circumferential groove cooperatively receiving the upper edge portion of the respective track of the pairs of tracks 50-51 and 52 for supporting the carriage in its reciprocating action. A plate, secured to and depending from the carriage rail 72 forwardly of the wheel 78, supports a carriage tracking wheel 79 subjacent the adjacent track 52 to maintain the carriage on the tracks.

Drive Means

Figures 2, 3:
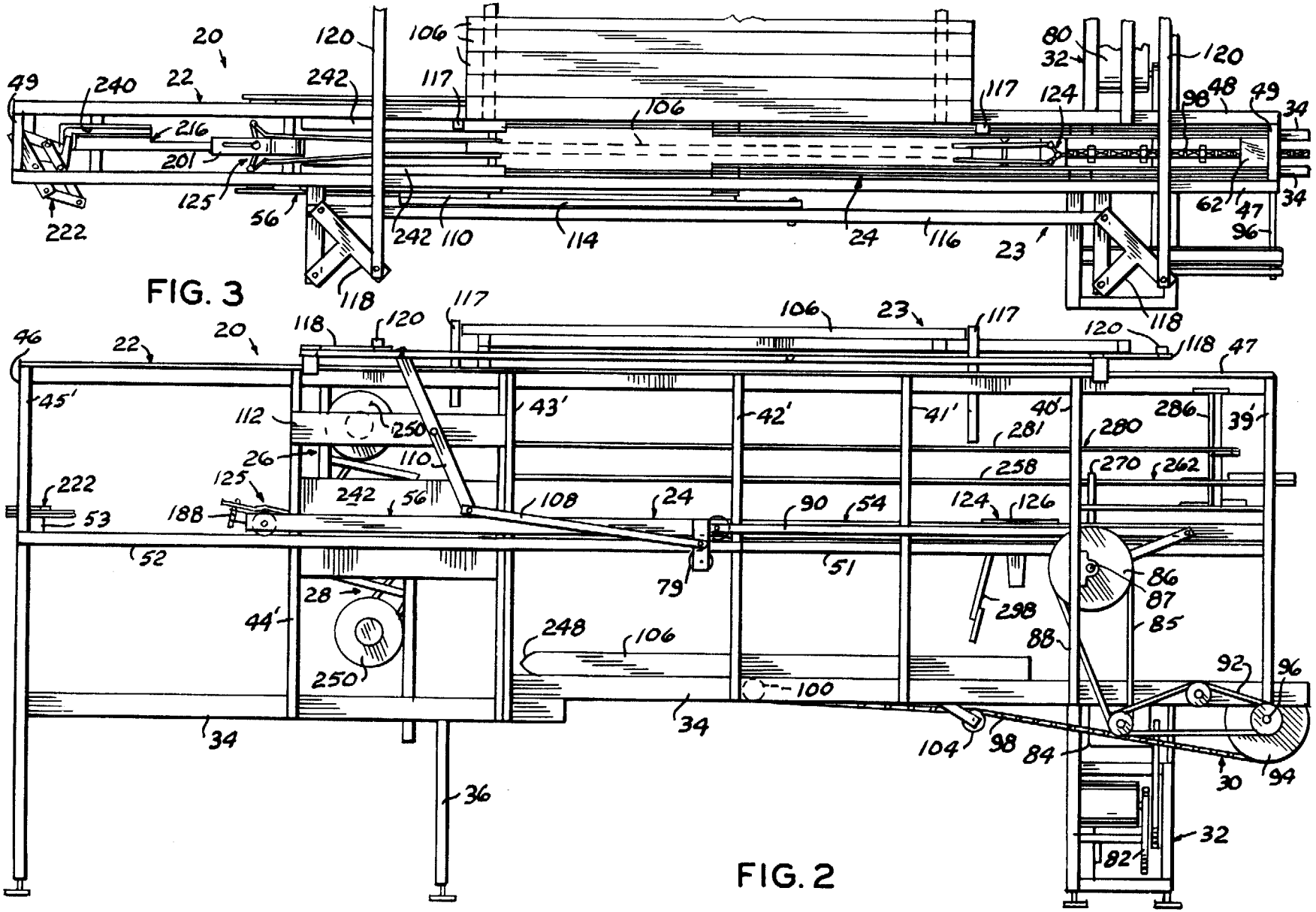
FIG. 2 is an elevational view of the opposite side of the machine and illustrating the relative position of a workpiece supply conveyor when connected therewith.
FIG. 3 is a fragmentary top view of FIG. 2 illustrating the machine at the end of its picket pointing cycle.
Figure 4:
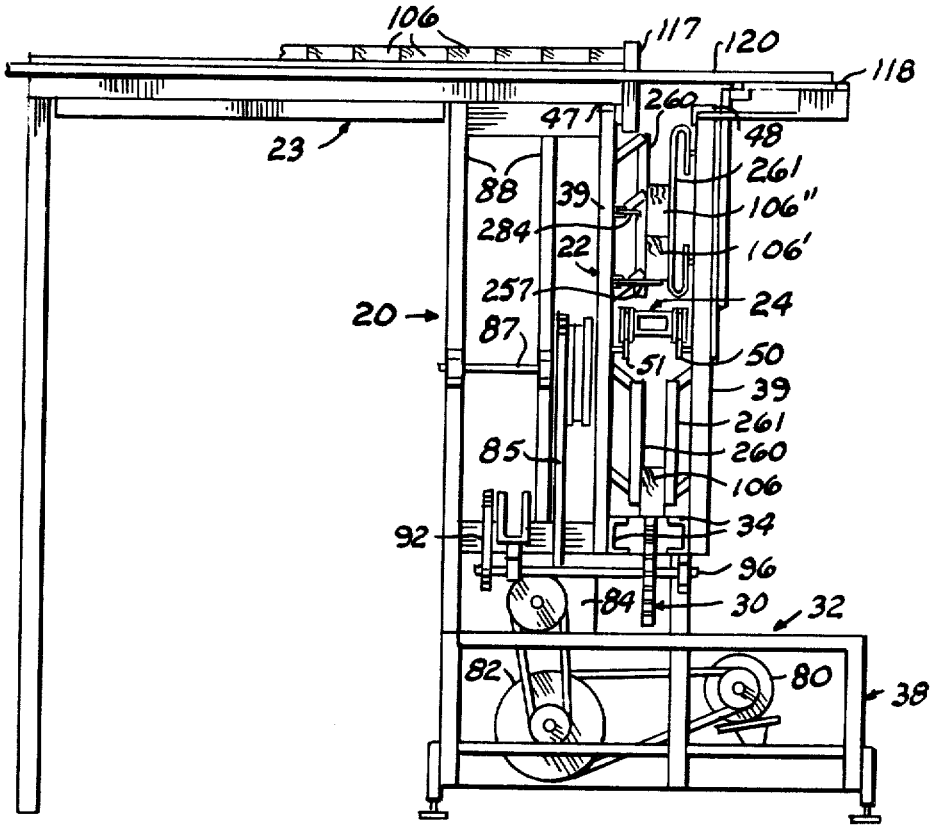
FIG. 4 is a left end elevational view of FIG. 2 with parts removed for clarity.

The drive means 32 comprises a reversible variable speed drive motor 80 mounted in the drive means frame 38 which, by belt and pulley means 82, drives a gear train 84, preferably provided with a mechanical clutch, not shown, (FIGS. 2 and 4). The output of the gear train 84 in turn drives a chain or belt 85 entrained around a pitman pulley 86 on a horizontal axle 87 bearing journalled by drive train standards 88 disposed laterally of the rearward end portion of the frame opposite the drive motor 80. A carriage pitman 90, connected at one end with the pitman pulley 86, is connected at its other end with the axle journalling the carriage wheels 65 and 78.

As best shown by FIG. 2, the gear train 84, by belt and pulley means 92, drives a workpiece discharge conveyor sprocket wheel 94 disposed between the rearward end portion of the frame channels 34 on an axle 96 extending horizontally between and journalled by bearings secured to their lower surfaces. A conveyor chain 98 is entrained around the conveyor wheel 94 and around a sprocket 100 between the channels 34 adjacent the pair of standards 43-43' over an intermediate sprocket 102 adjacent the standards 41-41' and over an idler pulley 104 pivotally supported by the channels 34 intermediate their ends.

Belt and pulleys are illustrated, except for the conveyor 30, for simplicity but obviously other chains and sprockets may be used to insure accurate timing sequence of moving components.

Operation of the drive motor 80 thus, by the belts and pulleys, or chains and sprockets, if used, gear train 84 and pitman 90, reciprocates the carriage 24 at a selected rate and magnitude of movement in accordance with the cutting operation to be performed on the respective workpiece 106, as presently explained.

Figure 10:
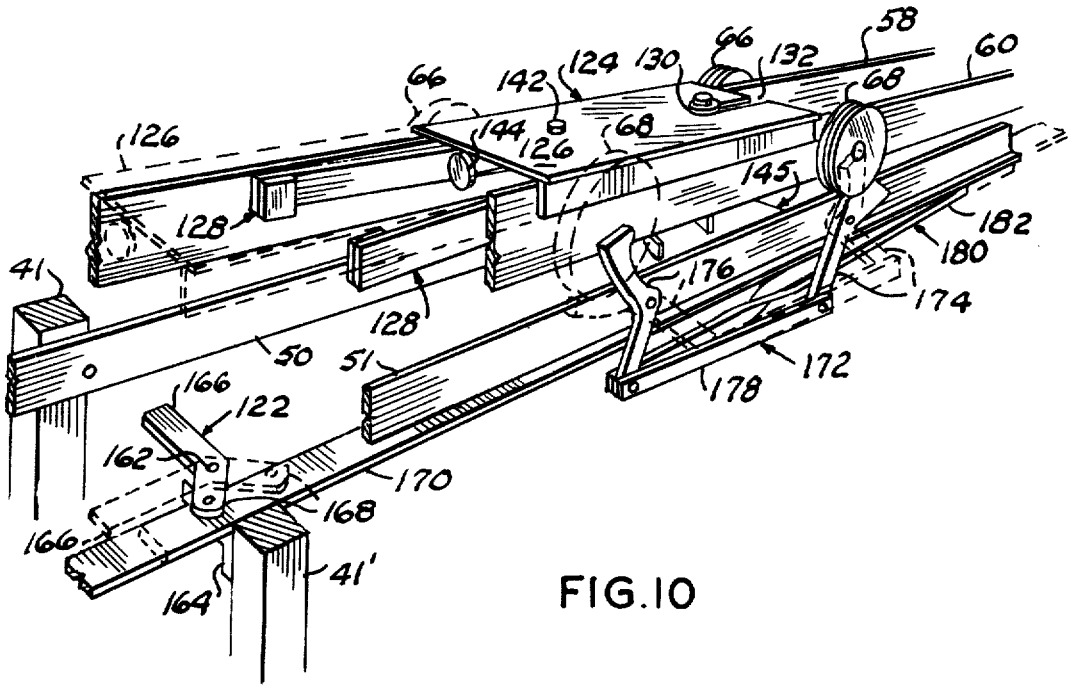
FIG. 10 is a fragmentary perspective view of the rearward end portion of the carriage illustrating, by solid and dotted lines, the manner in which the carriage wheel pivots lugs from a workpiece supporting position to a workpiece released position.
Figure 5:
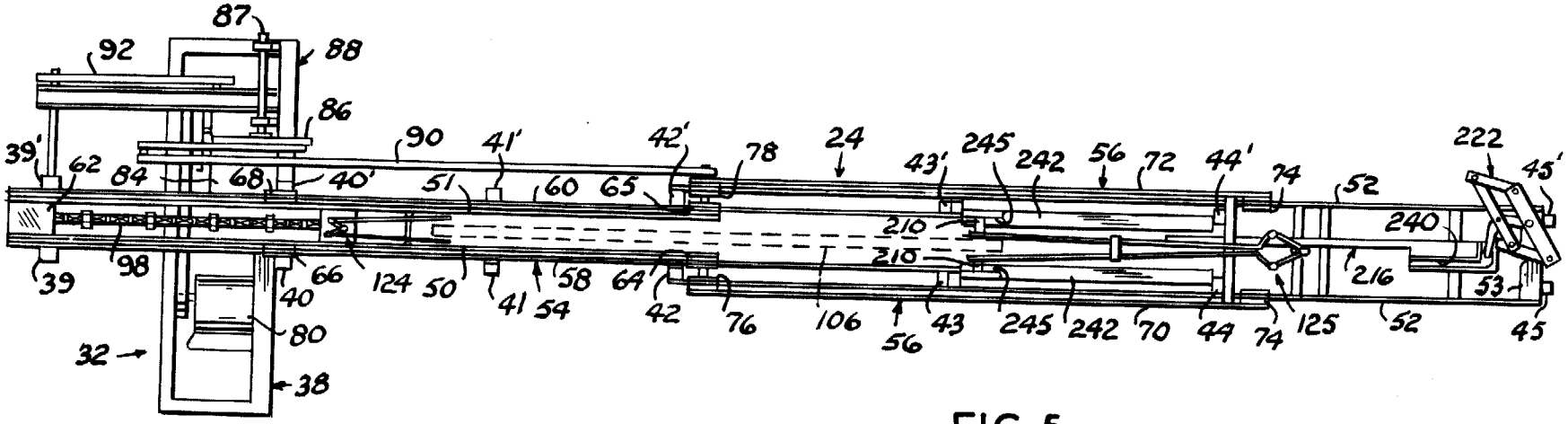
FIG. 5 is a horizontal sectional view taken substantially along the line 5—5 of FIG. 1 with some parts omitted for clarity and illustrating the machine in workpiece receiving position.
Figure 6:
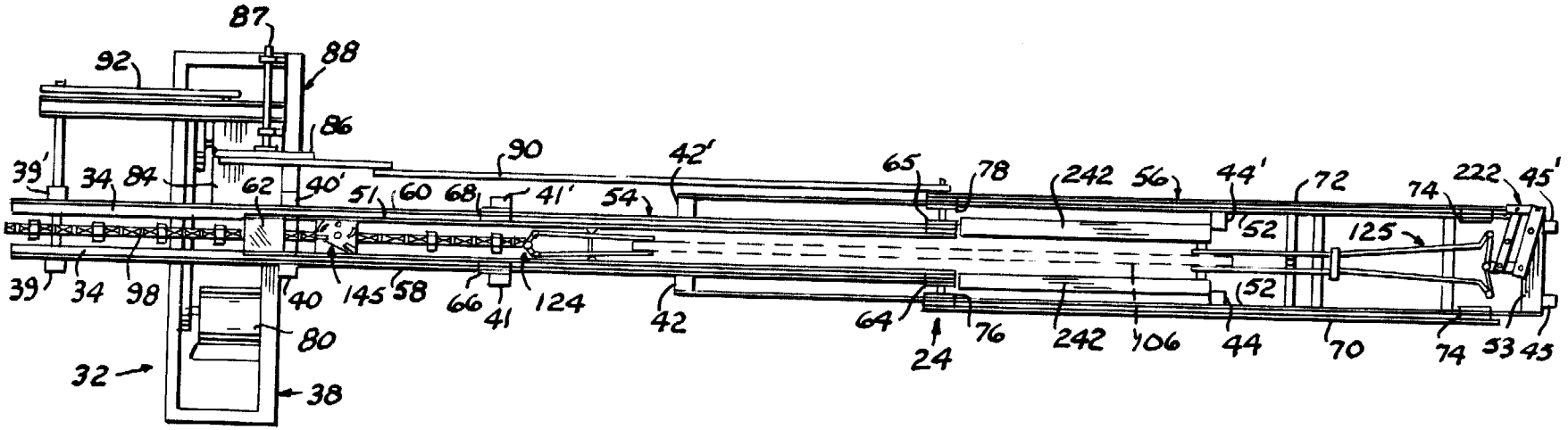
FIG. 6 is a view similar to FIG. 5 illustrating the machine in workpiece clamped position prior to processing.

Forward and rearward reciprocating movement of the carriage operates the supply conveyor 23 which partially overlies the frame 22 intermediate its ends and supports a plurality of the workpieces 106 laterally of the frame. This is accomplished by a pitman-like link 108 pivotally connected at one end to the support plate of the depending wheel 79 and connected at its other end with an arm 110 pivotally supported for vertical pivoting movement by a plate 112 extending between the standards 43' and 44' on the side of the frame opposite the drive motor 80 with the upper end of the arm 110 similarly connected with one end of an upper pitman supply conveyor arm 114 connected with a crank connecting link 116. The crank connecting link 116 is pivotally connected at its respective ends with one leg of a pair of horizontally pivoting bell crank members 118 reciprocating a pair of workpiece moving arms 120 which progressively move the workpieces 106 horizontally to fall edgewise, by gravity, into the frame between upstanding guide posts 117 toward the carriage 24, as best illustrated by FIG. 4. Downward movement of the workpiece 106 is interrupted by a shelf means comprising a plurality of retractable lugs 122, only one being shown (FIG. 10), projecting transversely inward from the frame standards 41', 42' and 43' in a horizontal plane defined by the lower limit of the tracks 50 and 51 so that the workpiece is horizontally supported between the tracks 50 and 51. As best shown by FIG. 5, the workpiece 106 is thus disposed between rearward clamp means 124 and forward clamp means 125.

Rearward Clamp Means

Figure 7:
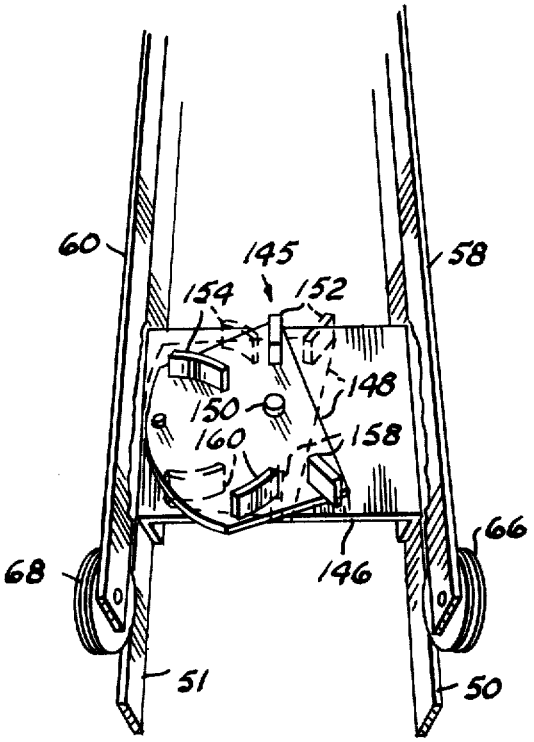
FIG. 7 is a fragmentary perspective view, to a larger scale, of the rearward workpiece clamp actuating cam illustrating, by dotted lines, the movement of the cam following actuation of the rearward clamp.
Figure 8:
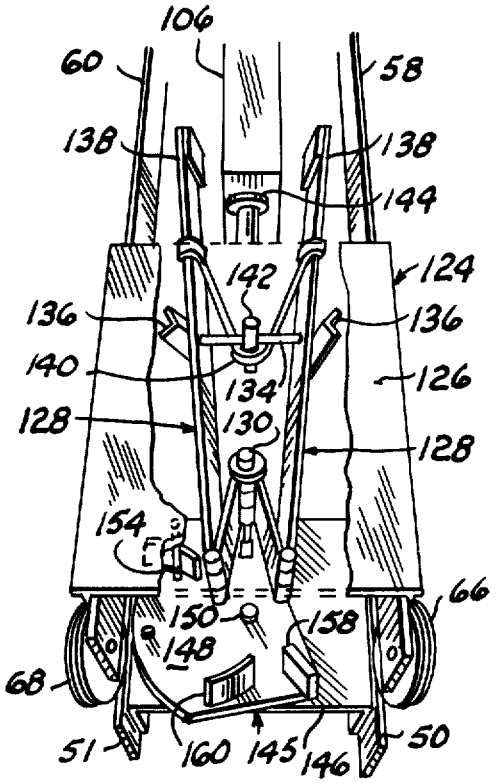
FIG. 8 is a fragmentary perspective view similar to FIG. 7 with parts broken away for clarity illustrating the position of the rearward clamp means prior to gripping the workpiece.
Figure 9:
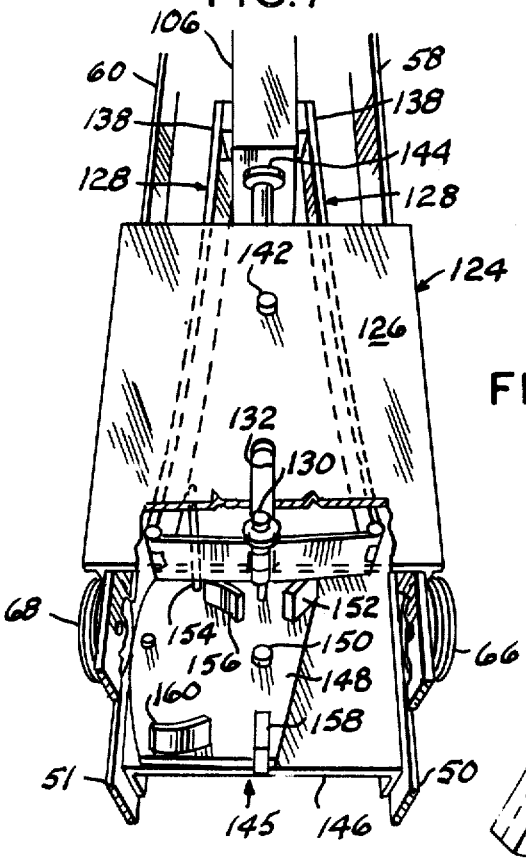
FIG. 9 is a view similar to FIG. 8 illustrating the rearward clamp means in workpiece gripping position and the clamp actuating cam pivoted to its dotted line position of FIG. 7.

Referring particularly to FIGS. 7, 8 and 9, the rearward clamping means 124 comprises an elongated plate 126 transversely overlying and secured to the rearward end portion of the carriage rails 58 and 60 forwardly of its rearward wheels 66 and 68. A pair of elongated spring steel clamp jaws 128 longitudinally underlie the plate 126 and are pivotally interconnected in toggle link fashion at their rearward end portions by a pivot pin 130 projecting vertically through an elongated longitudinally aligned slot 132 extending forwardly from the rearward end portion of the plate 126. A fulcrum bar 134, extending transversely through the clamp jaws intermediate their ends, is secured to a pair of angle members 136 to form a clamp jaw fulcrum secured to the depending surface of the plate 126. The forward end portion 138 of the clamp jaws are normally biased outwardly by a spring 140 interposed between the clamp jaws and supported by a pin 142 depending from the plate 126 at the position of the fulcrum bar 134. When the carriage 24 is moved forwardly by the pitman 90, the forward end portions 138 of the clamp jaws are disposed in spaced relation longitudinally of the workpiece and on opposing sides thereof by a stop 144 contacting the rearward end portion of the workpiece.

The rearward clamp 124 is actuated to grip and release the workpiece 106 by a rearward clamp cam means 145. The cam means 145 comprises a bridge plate 146 extending transversely between and secured to the rearward rails 50 and 51 below the rearward end portion of the rearward clamp plate 126 when the carriage is in start position. A cam plate 148 flatly overlies the bridge plate 146 and is secured thereto for horizontal pivoting movement by a bolt 150. A forward upstanding stop 152, mounted on the cam plate 148, is contacted by the depending end portion of the toggle link bolt 130 to pivot the toggle linkage to the workpiece clamp position, illustrated by FIG. 9, wherein the clamp jaws forward end portions 138 grip opposing sides of the workpiece 106. Continued forward movement of the carriage and the clamp means 124 moves a cam actuator rod 154 depending vertically from the rearward end portion of the clamp plate 126 which, by contacting an upstanding forward arcuate cam 156 secured to the cam plate 148, pivots the cam plate 148, to the solid line position of FIG. 9, to permit continued forward movement of the carriage. This action disposes the cam plate 148 in the position for releasing the rearward clamp toggle links following processing of the workpiece wherein a similar rearward upstanding stop lug 158, secured to the cam plate 148, is disposed in the path of travel of the toggle link bolt 130 during rearward movement of the carriage, toward its start position, so that the toggle link bolt 130 is biased forwardly during rearward movement of the carriage to release the rearward clamp jaws 128 from gripping engagement of the workpiece 106. Similarly the cam rod 154 contacts a rearward upstanding arcuate cam 160 on the cam plate 148 to bias the cam plate 148 to the carriage start position, illustrated by solid lines FIG. 7.

The workpiece 106 supporting shelf lugs 122 (FIG. 10) are bell crank-like and are pivotally connected, as at 162, for horizontal pivoting movement on a bracket 164 secured to the respective standard 41', 42' and 43' with one arm 166 projecting transversely of the frame and its other arm 168 pivotally secured to a reciprocable elongated bar 170 flatly subjacent the track 51 and moved longitudinally by cam lever means 172 to pivot the lugs 122 from a workpiece supporting position to a workpiece release position in response to forward and rearward movement of the carriage.

The cam lever means 172 comprises a pair of carriage wheel contacted cam levers 174 and 176 pivotally connected in spaced-apart relation longitudinally of the track 51 for vertical pivoting movement about horizontal axes. The depending ends of the cam levers are interconnected by a bar 178. An actuator link 180 is pivotally connected at one end with the depending end of the cam lever 176 and at its other end portion 182 to the depending surface of the reciprocable bar 170. In the carriage starting position, the rearward carriage wheel 68 is normally in position to pivot the depending end of the cam lever 174 forwardly disposing the bar 170 in its forward position and the respective lug 122 in workpiece supporting position. Upon forward movement of the carriage toward its workpiece grip position, as explained hereinabove, the wheel 68 releases the cam lever 174 and depresses the cam lever 176 toward its dotted line position thus biasing the bar 170 rearwardly which pivots the workpiece supporting lugs 122 to their dotted line position.

Forward Clamp Means

Figure 11:
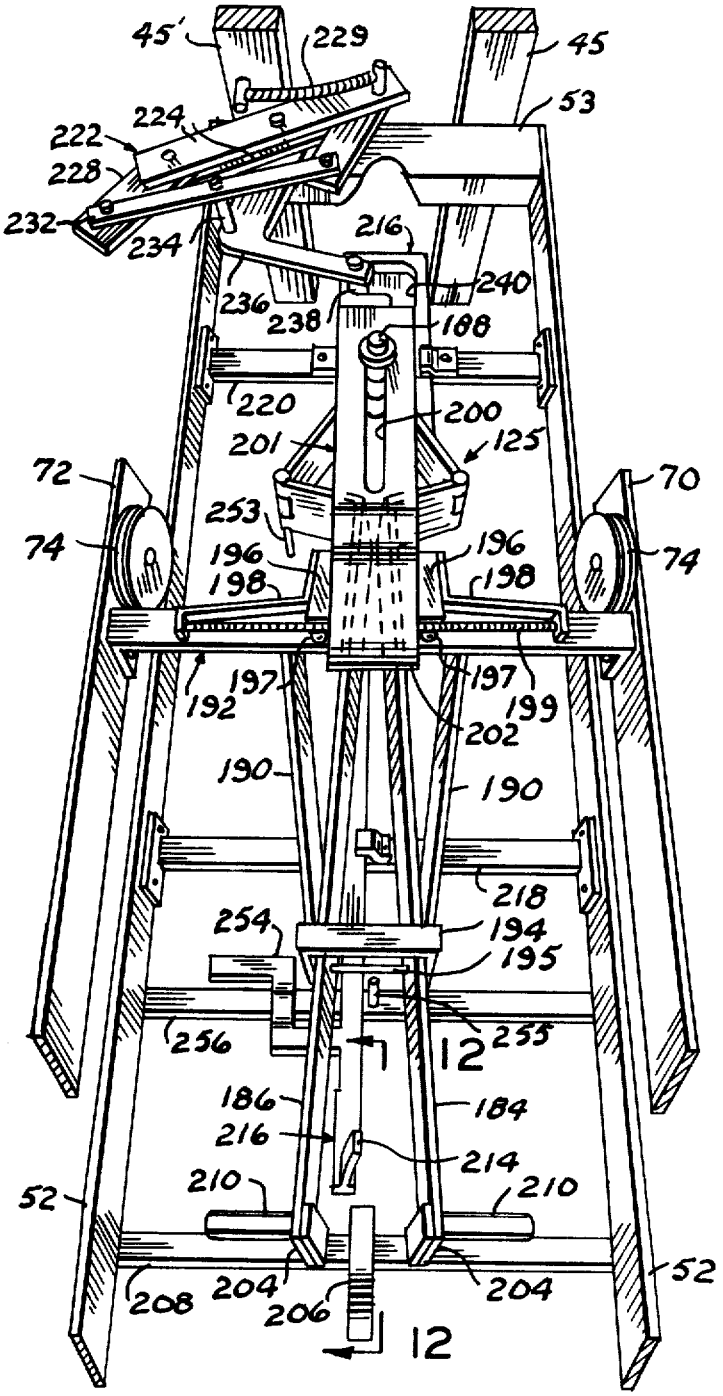
FIG. 11 is a fragmentary perspective view, to another scale, of the forward end portion of the carriage and the forward workpiece clamp means prior to gripping the workpiece.
Figure 13:
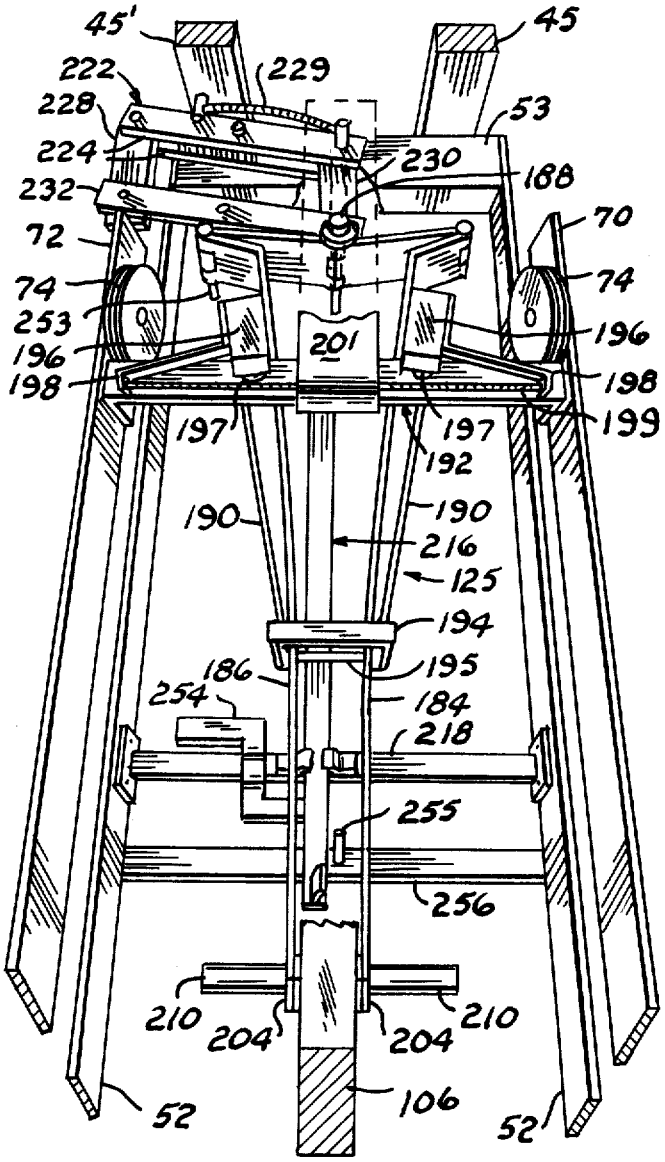
FIG. 13 is a perspective view similar to FIG. 11 illustrating the forward clamp means in workpiece clamped position.
Figure 12:
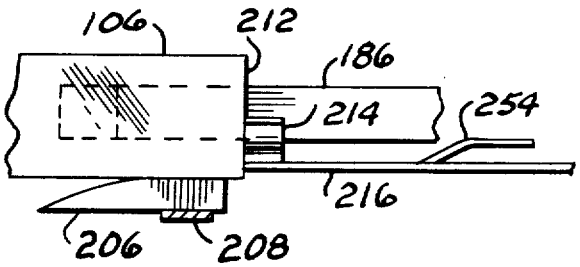
FIG. 12 is a fragmentary side elevational view, to a different scale, partially in cross section, taken substantially along the line 12—12 of FIG. 11.

Referring now to FIGS. 11, 12 and 13, the forward workpiece clamp means 125 comprises a pair of spring steel clamp jaws 184 and 186, extending longitudinally centrally of the forward end portion of the carriage and interconnected at their forward ends in toggle link fashion by a toggle bolt 188. The clamp jaws 184 and 186 are supported by a pair of clamp jaw support arms 190 secured at their forward ends to the depending surface of an inverted U-shaped bridge 192 extending transversely between the carriage forward rails 70 and 72 rearwardly of the carriage forward wheels 74 for vertical pivoting movement of the forward clamp means 125 about a horizontal axis for the purposes presently explained. The other end of the clamp jaw support arms 190 are secured to the legs of an inverted U-shaped bracket 194 straddling the clamp jaws 184 and 186 intermediate their ends with a fulcrum bar 195 extending between the clamp jaws. The clamp jaws 184 and 186 are further supported by a pair of blocks 196, secured to the respective clamp jaw with one end portion of the respective block overlying the bridge 192 and supported by friction reducing rollers 197. A pair of angle brackets 198 are secured to the respective block 196 and overlie, at one end portion, the bridge 192. A spring 199, extending between the brackets 198, biases the toggle link connected ends of the clamp jaws toward each other. The clamp jaws toggle linkage is guided by the toggle bolt 188 projecting vertically through and slidable in an elongated slot 200 formed in a toggle support tongue 201 longitudinally overlying the toggle linkage and turned down at its rearward end 202 and secured to the rearward limit of the bridge 192. In the clamp open position, the rearward ends 204 of the clamp jaws 184 and 186 are disposed in spaced relation on opposing sides of the forward end position of the workpiece 106.

Forward movement of the carriage, after the rearward clamp means 124 has gripped the workpiece, moves the depending surface of the workpiece 106 into contact with a lifting cam 206 (FIG. 12) supported by a cross bar 208 transversely secured to the depending surface of the tracks 52 to lift the forward end portion of the workpiece and dispose it centrally between the rearward end portions 204 of the clamp jaws 184 and 186. The rearward end portions of these clamp jaws are provided with a pair of oppositely directed cam rollers 210 following guide cams for moving the workpiece into contact with the cutting means 26 and 28, as presently explained.

The forward end surface 212 of the workpiece (FIG. 12) abuts a tongue lug 214 formed on the rearward end portion of an elongated guide tongue 216 extending longitudinally toward the forward end of the frame and slidably supported by transverse braces 218 and 220 secured to the inner surface of the forward tracks 52. Forward movement of the tongue 216 actuates a forward clamp jaw trigger means 222 for biasing the clamp jaws 184 and 186 into gripping contact with the forward end portion of the workpiece 106.

The clamp triggering means 222 comprises a plurality of horizontally pivoting links arranged in parallelogram fashion with one pair of links 224 forming one side of the parallelogram and pivotally connected intermediate their ends by a pin 226 mounted on the track end connecting cross bar 53. End links 228 and 230 connect the ends of the pair of the side links 224 to an opposite side link 232 having a depending pin 234 intermediate its ends secured to a bell crank 236 having one arm journalled by the pin 226 and its other arm provided with a depending roller 238 slidable in an upwardly open groove 240 formed in the forward end portion of the guide tongue means 216. Forward movement of the tongue means 216 horizontally pivots the bell crank 236 in turn pivoting the trigger means 222 to the clamp jaw closing position illustrated by FIG. 13 wherein the forward end of the carriage rail 72 abuts the adjacent end of the trigger end link 228 and pivots the other end link 230 toward the toggle link bolt 188. This pivots the forward end portions of the clamp jaws 184 and 186 in opposing directions to set the toggle links and grip the workpiece 106 by their rearward end portions 204. A spring 229, connecting the links 224 with the standard 45', assists in maintaining the trigger means 222 in its respective positions.

Cam Plates

Figure 16:
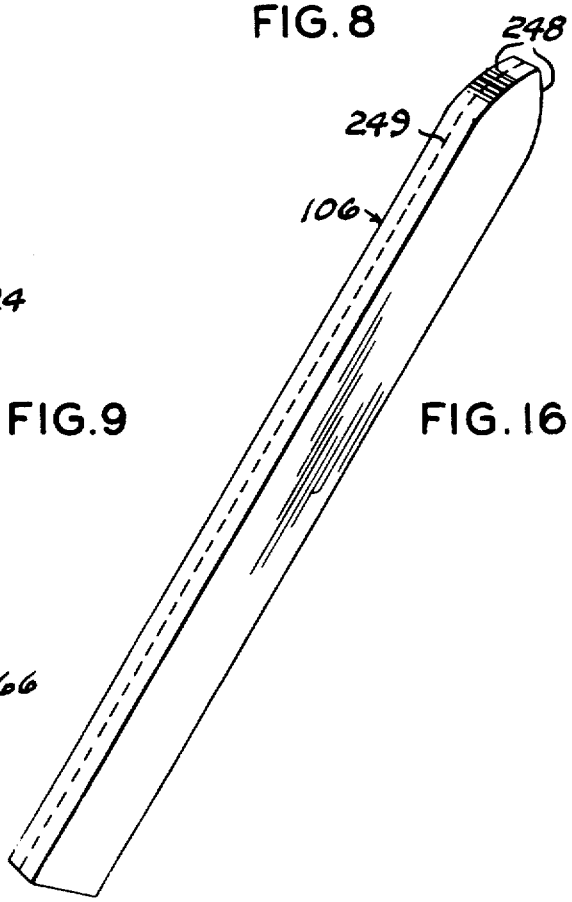

A pair of cam plates 242 (FIGS. 1, 2, 5 and 6) extend vertically edgewise in parallel spaced relation between the pairs of standards 43-43' and 44-44' on opposing sides of the travel path of the forward clamp jaws 184 and 186. Each of the cam plates 242 are provided with a cam groove 243 (FIG. 1) having a horizontal portion 244 and 245 at its forward and rearward limits, respectively, and having arcuate curves 246 and 247 formed on a curve complemental with the arcuate cuts defining the gothic arch 248 to be formed on the end portion of the respective workpiece 106 (FIG. 16).

The cutter means 26 and 28 are substantially identical, each comprising a frame supported motor 250 driving a rotary cutter head 252 by belt and pulley means with the cutter head disposed between the cam plates 242 adjacent the respective cam curve 247 and 246 so that the desired arcuate curve 248 is formed on the ends of the workpiece by the forward clamp rollers 210 following the cam groove 243 and guiding the workpiece between the cam plates 242, as presently explained.

The above described workpiece clamping action of the forward clamp means 125 takes place at the limit of the forward movement of the carriage with the clamp jaw rollers 210 within the cam groove portion 244. As the carriage reverses direction and moves toward the rearward end of the machine, toward the left, as viewed in FIGS. 1, 5 and 6, the clamp jaw rollers 210, by following the groove 243 in the cam plates 242, moves the workpiece vertically along the arcuate cam portion 246 and then downwardly and along the arcuate cam portion 247 wherein the forward clamp means supporting bridge 192 permits this vertical movement. The guide tongue 216 is moved rearwardly of the frame with the forward clamp means 125 to pivot the trigger means 222 to the position of FIG. 11 by a pin 253 depending from the toggle linkage contacting a pilot arm 254 projecting laterally of the rearward end portion of the guide tongue 216 in the path of travel of the pin 253. This repositioning of the trigger means 222 is necessary to prevent closing the forward clamp jaws 184 and 186 in the event the carriage moves forwardly without a workpiece 106 in position. Adjacent the rearward limit of the carriage travel when the rollers 210 are disposed within the cam groove portion 245, as illustrated by FIGS. 1 and 5, the depending end portion of the forward clamp means toggle bolt 188 contacts an upstanding release pin 255 supported by a track connected cross bar 256, to release the clamp jaw toggle links and bias the clamp jaw rearward end portions 204 open and release the workpiece 106.

Simultaneously, with this action, the rearward clamp means 124 toggle bolt 130 has contacted its cam stop 158 to release the rearward end portion of the workpiece. As illustrated by FIG. 1, the workpiece 106 falls by gravity on the conveyor 98 which moves the workpiece longitudinally out of the rearward end of the machine to a resaw station, not shown, which longitudinally splits the workpiece 106 along the dotted line 249 (FIG. 16) to form a pair of pickets, not shown, each having one arcuate pointed end. When the carriage 24 is at the limit of its rearward movement toward the left, as viewed in FIG. 1, the carriage is again positioned for receiving another workpiece 106 to be processed.

Workpiece Storage And Feed Means

Figure 14:
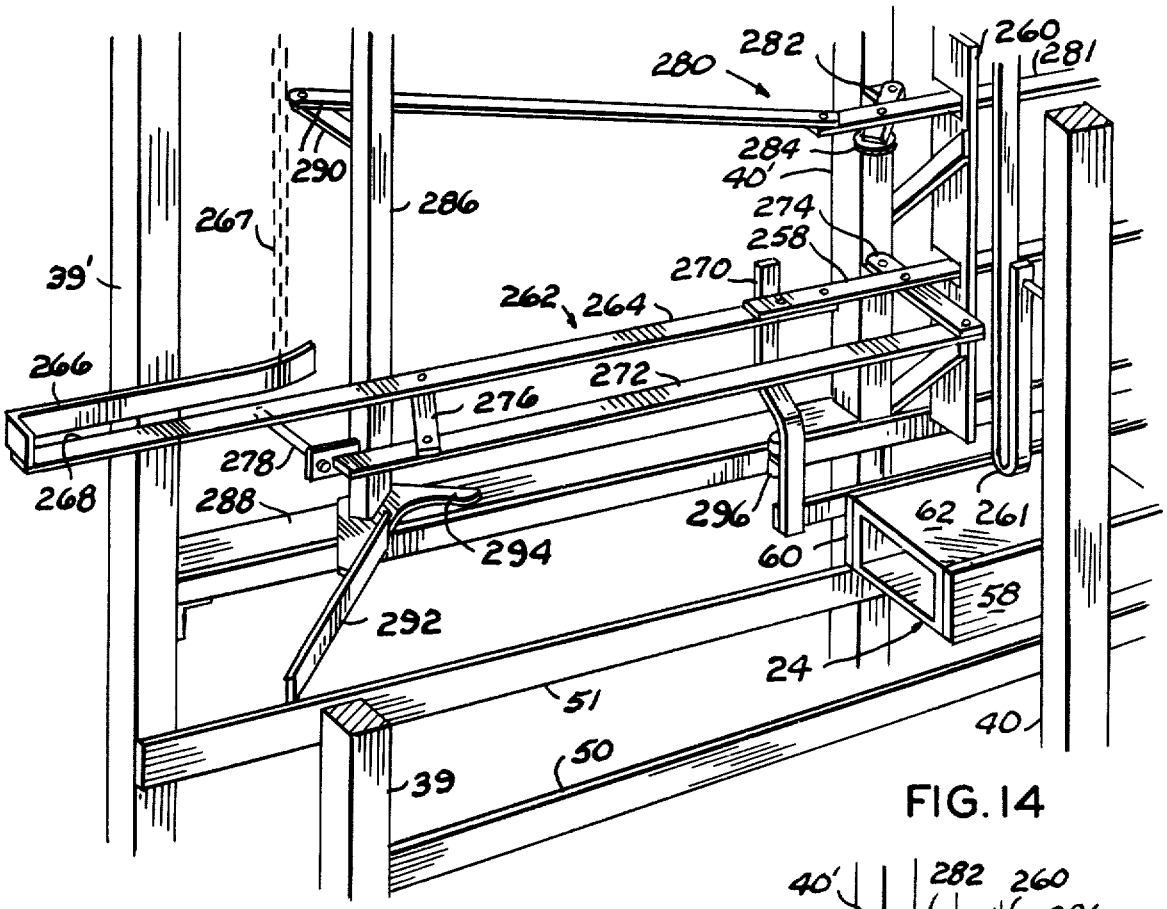
FIG. 14 is a fragmentary perspective view, to an enlarged scale, of the rearward end portion of the machine illustrating workpiece support and release linkage in workpiece supporting position.
Figure 15:
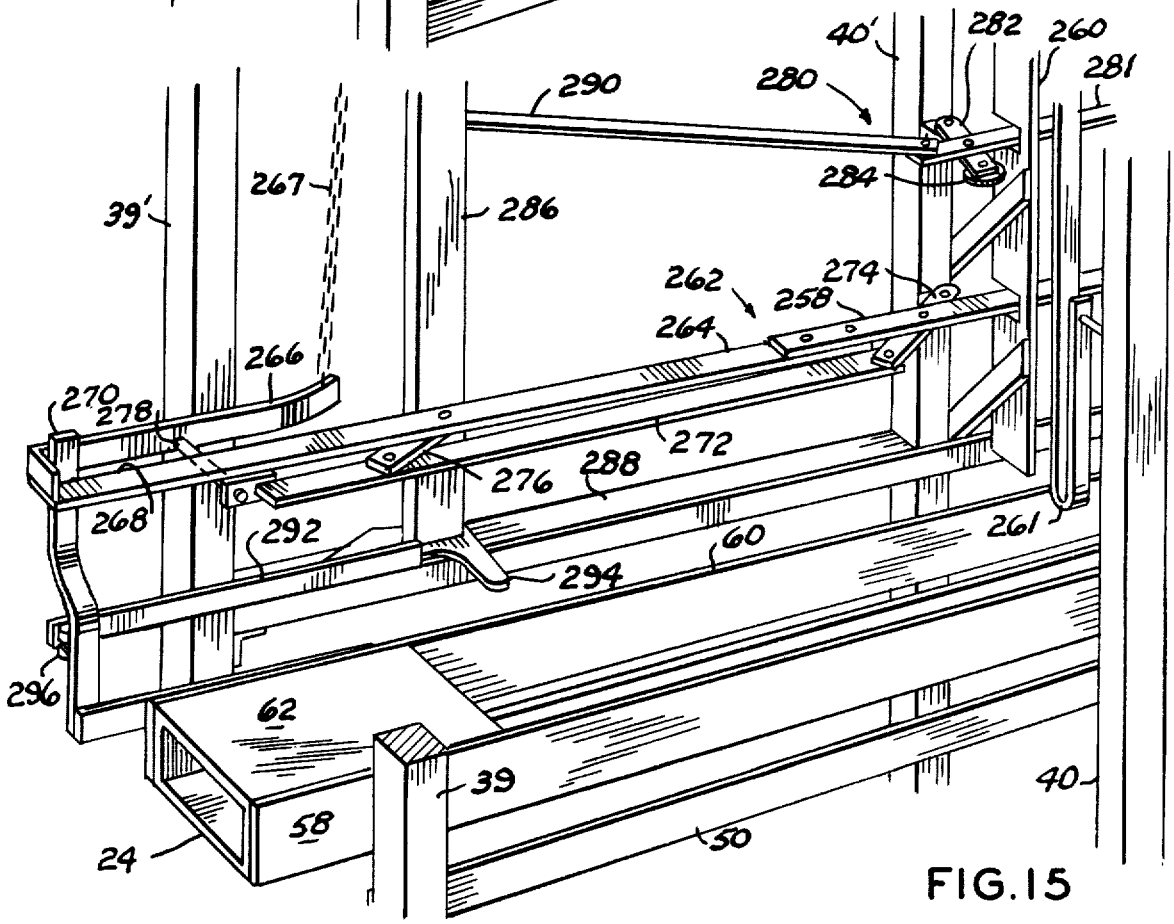
FIG. 15 is a view similar to FIG. 14 illustrating the manner in which the carriage pivots the workpiece supporting linkage to a carriage feed position by rearward movement of the carriage; and, FIG. 16 is a perspective view, to another scale, of one of the finished workpieces.

The rate of travel of the carriage, in its forward and rearward movement, is constant in positioning the workpiece to be gripped and performing the cutting action and this time lapse is equal to the time required by the resaw apparatus to split the workpiece. For a continuous uninterrupted processing of the workpiece it is desired that a subsequent workpiece be adjacent the carriage workpiece receiving position following the carriage release action of a processed workpiece. This is accomplished by storing a plurality two or more, of the workpieces 106, one above the other, within the frame above the carriage, as best illustrated by FIG. 4, wherein two workpieces 106' and 106'' are temporarily stored in superposed relation. The workpiece 106' is horizontally supported in the frame above the carriage 24 by another retractable shelf means comprising a plurality of support lugs 257 (FIG. 4) similar to the previously described lugs 122 adjacent the standards 41', 42' and 43' and similarly movable by a longitudinally movable release bar 258 (FIGS. 14 and 15).

The workpiece 106" normally is supported by the upper surface of the lower workpiece 106'. The workpieces are maintained vertically edgewise centrally of the frame during their movement toward and away from the carriage by a plurality of vertical guide bars 260 and 261 disposed inwardly of the frame sides above and below the carriage 24. Carriage actuated workpiece feed bar means 262 (FIGS. 14 and 15) release the workpiece 106' to the lugs 122 and carriage 24 and prevent downward movement of the workpiece 106".

The bar means 262 comprises a bar extension 264 secured to the release bar 258 and projecting horizontally rearward therefrom beyond the rearward end of the frame. A cam rail 266, laterally secured at one end to the rearward end of the bar 264, projects horizontally forward into the rearward end portion of the frame and is supported at its other end by a chain 267 depending from the frame top rail 47 to define a longitudinal slot 268 which slidably receives the upper end portion of an upstanding stub bar 270 secured to the rearward end portion of the carriage 24 so that when the carriage reaches the rearward limit of its travel, as shown by FIG. 15, the post 270, by entering the slot 268, moves the bars 258 and 264 longitudinally rearward thus pivoting the support lugs 257 from supporting relation under the workpiece 106' and allowing the latter to fall by gravity, a relatively short distance, to the lugs 122. The bar means 262 further includes a companion bar 272 parallel with the bar 264 and pivotally connected at its forward end with the bar 258 by an end link 274 also pivotally connected to the standard 40' with the companion bar 272 pivotally connected intermediate its ends by another link 276 with the bar 264. Rearward movement of the post 270, moving the bars 258 and 264, pivots the companion bar horizontally toward the bar 264. The rearward end portion of the companion bar 272 supports a pin 278 extending horizontally toward the cam bar 266 and intersecting the forward travel of the post 270 in the slot 268. The purpose of the pin 278 is so that when contacted by the post 270, in response to forward movement of the carriage, the bars 258 and 264 will be moved forwardly with the carriage to reposition the workpiece supporting bars 257 to receive and support the other workpiece 106".

Workpiece holding cam means 280, operated by the stub post 270, maintain the upper workpiece 106" stationary when the workpiece 106' is released to fall into the carriage. The workpiece holding cam means 280 comprises a horizontal bar 281, disposed above the bar 258, extending longitudinally between the standards 40', 41', 42' and 43' which is supported for longitudinal movement by a like plurality of cam arms 282, only one being shown (FIGS. 14 and 15), secured at one end to the respective standard and having a wheel-like cam 284 on its other end supported for horizontal rolling movement into and out of contact with the adjacent surface of the workpiece 106" in the manner presently explained.

A pivoting post 286 extends vertically between a horizontal brace 288, extending between the standards 39' and 40', and the frame top rail 47, for horizontal pivoting movement about a vertical axis adjacent the rearward end of the frame. A pair of links 290 horizontally connect the rearward end of the bar 281 with the post 286. The depending end portion of the post 286 is provided with bell crank-like cam arms 292 and 294 wherein a carriage guide roller 296, secured to an intermediate portion of the stub post 270, pivots the cam arm 292 toward the post support brace 288 thus, by the links 290 moving the bar 281 forwardly and forcing the cam wheels 284 into contact with the adjacent surface of the workpiece 106", which is impinged against the workpiece guide 261. When the carriage again moves forwardly the stub post roller 296, by contacting the cam arm 294, pivots the post 286 in an opposite direction to release the workpiece 106" to fall by gravity on the support arms 257.

Summary of Operation

Assuming the feed conveyor 23 has deposited a plurality of the workpieces within the workpiece travel path of the frame so that one of the workpieces 106 is temporarily supported within the carriage by the shelf lugs 122 and the workpieces 106' and 106" are supported by the retractable bar shelf means 262, the drive means 32, by operating the pitman 90, moves the carriage 24 forwardly so that the stop 144 of the rearward clamp means 124 abuts the adjacent rearward end of the workpiece 106. The rearward clamp means toggle bolt 130, contacting the cam stop 152, actuates the rearward clamp jaws 128 to grip the rearward end of the workpiece (FIG. 9). Forward movement of the carriage has positioned the forward end of the workpiece on the cam lift 206 so that the workpiece moves the tongue 216 forwardly with the carriage to pivot the trigger means 222 to its position of FIG. 13 which actuates the toggle links of the forward clamp means 125 to grip the forward end of the workpiece 106. Simultaneously, with the closing action of the forward clamp jaws 184 and 186, the rearward carriage wheel 68, by depressing the cam lever 176, pivots the retractable shelf lugs 122 out of supporting relation under the workpiece 106, the workpiece 106 is thus supported by the rearward and forward clamp means 124 and 125. The carriage is now at its forward limit of travel, being reversed in its travel by the pitman 90, wherein the cam rollers 210, on the forward clamp jaws, follow the cam grooves 243 to sequentially dispose opposing edge surfaces of the forward end portion of the workpiece in contact with the rotary cutters 252 to form the arcuate pointed end 248 of the workpiece. Adjacent the rearward limit of carriage travel, the respective rearward and forward clamp jaws, toggle bolts 130 and 188 contact their releasing stops 158 and 255 to open the respective clamp jaws, releasing the workpiece 106 to fall by gravity out of the carriage 24 to the discharge conveyor chain 98. The rearward travel movement of the carriage, by the rearward carriage wheel 68 pivoting the cam lever 174, positions the retractable shelf lugs 122 for receiving the workpiece 106' and this rearward movement of the carriage simultaneously actuates the workpiece feed levers 262 and workpiece holding lever means 280 permitting the workpiece 106' to fall by gravity on the retractable lugs 122 while the workpiece 106" is maintained stationary by the lever means 280. As the carriage 24 again begins its cycle of forward movement the workpiece release levers 262 are positioned for receiving the workpiece 106" released by the cam lever means 280. Simultaneously with this action forward and rearward movement of the carriage 24 has operated the feed conveyor means 23 to dispose another workpiece on top of the workpiece 106".

The frame is preferably provided with mechanical clutch release levers 298 depending from the rearward position of the carriage so that, in the event of a malfunction of the discharge conveyor 30, two or more workpieces deposited on the discharge conveyor pivots the clutch release lever 298 to a clutch inoperative position to stop the machine for correction of the malfunction.

Obviously, minor adjustments may be made to the frame, the position of the rearward clamp means 124 and its cam means 145 to accommodate workpieces of selected lengths and widths.

Obviously the invention is susceptible to changes or alterations without defeating its practicability. Therefore, I do not wish to be confined to the preferred embodiment shown in the drawings and described herein.

I claim:

1. An automatic picket pointing machine, comprising:

an elongated upright open frame having spaced-apart sides defining a vertical workpiece passage path intermediate its ends and open toward one end of the frame for receiving horizontally disposed workpieces from a supply conveyor;

carriage means having opposite end portions intersecting the vertical workpiece path and horizontally reciprocable between the ends of said frame;

drive means operatively connected with said carriage for reciprocating the latter;

retractable carriage movement operated shelf means projecting inwardly from one said frame side for horizontally supporting an elongated workpiece in the plane of said carriage;

rotary cutter means supported by said frame above and below the carriage travel path;

workpiece clamp means supported by said carriage for gripping opposing lateral sides of and moving the workpiece with said carriage;

clamp opening and closing means for closing said clamp means in response to carriage movement in one direction and for opening said clamp means in response to carriage movement in the opposite direction;

cam means cooperating with said clamp means for sequentially moving opposing edge surfaces of one end portion of the workpiece into contact with said rotary cutter means; and, discharge conveyor means for moving the workpiece out of said frame.

2. The machine according to claim 1 in which said carriage means comprises:

horizontal track means extending longitudinally of said frame intermediate its height;

a plurality of pairs of carriage wheels supported by said tracks;

a plurality of rails journalling said plurality of wheels; and, means transversely interconnecting the rails at said respective end portions of the carriage.

3. The machine according to claim 2 in which said clamp means comprises:

a pair of clamp jaws extending longitudinally of a respective end portion of said carriage;

toggle links pivotally joining one end portion of each pair of said clamp jaws; and, spring means normally biasing the other end portion of each pair of clamp jaws open.

4. The machine according to claim 3 in which said clamp opening and closing means includes:

a horizontal cam plate pivotally supported by said tracks for horizontal oscillative movement below one said pair of clamp jaws when said carriage is at one end of its travel;

at least one upstanding cam stop on said horizontal cam plate disposed in the path of travel and contacting said clamp jaw toggle links during respective directions of movement of said carriage; and, means for pivoting said horizontal cam plate between clamp jaw opening and closing positions in response to movement of said carriage in each direction.

5. The machine according to claim 3 in which said clamp opening and closing means includes:

trigger means comprising a plurality of pivotally interconnected links supported by one end portion of said frame in the travel path of the toggle links of one said pair of clamp jaws for biasing said one pair of clamp jaws closed in response to movement of said carriage in one direction; and, an upstanding stop supported by said carriage tracks in the travel path of and contacted by the toggle links for biasing said clamp jaws open when said carriage is adjacent the limit of travel in said one direction.

6. The machine according to claim 5 in which said clamp opening and closing means further includes:

an elongated tongue means longitudinally slidably supported by said tracks at said one end portion of said frame below the travel path of said one pair of clamp jaws; and, a bell crank connecting one end portion of said tongue means with the trigger means links for pivoting said trigger means links toward a toggle link clamp jaw closing position in response to movement of said tongue means toward said frame one end portion, said tongue means being moved toward said frame one end portion by a workpiece supported by said carriage.

7. The machine according to claim 4 or 6 in which said cam means includes:

a pair of cam plates vertically disposed at respective sides of one end portion of said frame adjacent the rotary cutter means and respective sides of the carriage, said vertical cam plates each having a coextensive elongated cam groove arranged in confronting relation with respect to each other; and a cam roller disposed within the respective cam groove and respectively connected with the end portion of each clamp jaw of one said clamp means opposite its toggle link connection.

8. The machine according to claim 7 in which said drive means includes:

a reversible variable speed motor;

a pitman connected with said carriage; and, belt and pulley means drivably connecting said motor with said pitman.

9. The machine according to claim 8 in which said discharge conveyor means includes:

sprocket wheels journalled by one end portion of said frame, at least one said sprocket wheel being driven by said motor; and, a conveyor chain entrained around said sprocket wheels.

* * * * *